US009852482B2

(12) United States Patent
Grunin et al.

(10) Patent No.: US 9,852,482 B2
(45) Date of Patent: Dec. 26, 2017

(54) UTILITY CONSUMPTION ADVISOR

(71) Applicant: International Business Machines Corporation, Armonk, NY (US)

(72) Inventors: Galina Grunin, Briarcliff Manor, NY (US); David E. Nachman, Stanford, CT (US); Nader M. Nassar, Yorktown Heights, NY (US); Tamer Nassar, Bethel, CT (US)

(73) Assignee: International Business Machines Corporation, Armonk, NY (US)

( * ) Notice: Subject to any disclaimer, the term of this patent is extended or adjusted under 35 U.S.C. 154(b) by 674 days.

(21) Appl. No.: 14/198,354

(22) Filed: Mar. 5, 2014

(65) Prior Publication Data

US 2015/0253745 A1 Sep. 10, 2015

(51) Int. Cl.
*G06Q 50/06* (2012.01)

(52) U.S. Cl.
CPC ..... *G06Q 50/06* (2013.01)

(58) Field of Classification Search
CPC ..... G06Q 50/06
USPC ..... 700/291
See application file for complete search history.

(56) References Cited

U.S. PATENT DOCUMENTS 4,261,037 A * 4/1981 Hicks ..... G06Q 50/06 324/103 R
5,598,349 A * 1/1997 Elliason ..... G06Q 50/06 700/295
7,062,361 B1 * 6/2006 Lane ..... F25D 29/00 700/291
7,379,997 B2 † 5/2008 Ehlers
7,853,486 B2 12/2010 Grove et al.
8,095,233 B1 1/2012 Shankar et al.
(Continued)

FOREIGN PATENT DOCUMENTS

EP 1159779 B1 12/2001
EP 1403998 A3 3/2004

OTHER PUBLICATIONS

Castillo-Cagigal, M., et al., "Heterogeneous Collaborative Sensor Network for Electrical Management of an Automated House with PV Energy," Sensors, 2011, pp. 11544-11559, vol. 11.
(Continued)

*Primary Examiner* — Ryan Coyer
(74) *Attorney, Agent, or Firm* — Cahn & Samuels, LLP

(57) ABSTRACT

An embodiment of the invention provides a method for a utility consumption advisor, wherein a target electricity consumption for a predefined time period is received with a user interface. User parameters are also received with the user interface, the user parameters including a list of electricity consumption items that may not be modified, a list of electricity consumption items that may be modified, and a range of modification for each of the listed electricity consumption items that may be modified. The user's electricity consumption history is determined; and, an electricity utilization plan is generated for the predefined time period with a processor. The electricity utilization plan is generated based on the target electricity consumption, the user parameters, and the user's electricity consumption history. The electricity utilization plan is implemented by wirelessly controlling the electricity consumption items that may be modified.

11 Claims, 5 Drawing Sheets

(56) References Cited

U.S. PATENT DOCUMENTS

| | | | | |
|---|---|---|---|---|
| 8,145,361 | B2 | 3/2012 | Forbes, Jr. et al. | |
| 8,160,752 | B2 * | 4/2012 | Weaver | H02J 3/14 315/307 |
| 8,180,691 | B2 | 5/2012 | Cao et al. | |
| 8,183,995 | B2 | 5/2012 | Wang et al. | |
| 8,463,448 | B2 * | 6/2013 | Burt | H02J 3/14 700/286 |
| 8,606,419 | B2 * | 12/2013 | Besore | H02J 3/14 700/291 |
| 2003/0012373 | A1 * | 1/2003 | Ogura | G03F 7/70508 380/30 |
| 2004/0128266 | A1 | 7/2004 | Yellepeddy et al. | |
| 2004/0138981 | A1 * | 7/2004 | Ehlers | F24F 11/0012 705/36 R |
| 2009/0196265 | A1 * | 8/2009 | Mariblanca Nieves | H04W 8/065 370/338 |
| 2012/0053739 | A1 | 3/2012 | Brian et al. | |
| 2012/0053740 | A1 | 3/2012 | Venkatakrishnan et al. | |
| 2013/0094056 | A1 * | 4/2013 | Kobayashi | G06F 3/1208 358/1.15 |

OTHER PUBLICATIONS

Morales, R., et al., "Distributed Smart Device for Monitoring, Control and Management of Electric Loads in Domotic Environments," Sensors, 2012, pp. 5212-5224, vol. 12.

"Setting up Appliance Usage by Energy Costs", IP.com, IPCOM000015102D, Sep. 13, 2001.

IBM, "Method and System for Centralize Appliances Power Management", IP.com, IPCOM000177744D, Dec. 29, 2008.

IBM, "Smart Electricity Management Using Profile-Based Discovery, Classification and Alerting", IP.com, IPCOM000184265D, Jun. 17, 2009.

"Token Based Adaptive Electric Power Management System", IP.com, IPCOM000193845D, Mar. 10, 2010.

"Method and System for Self-Managing the Power Consumption of Domestic Appliances", IP.com, IPCOM000202233D, Dec. 10, 2010.

* cited by examiner
† cited by third party

| Utility consumption item | Permitted consumption (in kWh) |
|---|---|
| Refrigerator | 725 kWh |
| Stove | 300 kWh |
| Microwave | 850 kWh |
| Dishwasher | 1850 kWh |
| Water Filter | 125 kWh |
| Washer | 500 kWh |
| Dryer | 3000 kWh |
| Water Heater | 5250 kWh |
| Air Conditioner | 900 KWh |
| Heater | 750 kWh |
| Television Unit | 108 kWh |
| Desktop Computer | 75 kWh |

FIG. 4

UTILITY CONSUMPTION ADVISOR

BACKGROUND

The present invention is in the field of systems, methods, and computer program products for receiving data from a user regarding utility consumption and utility consumption items in a building.

Houses, offices, and other building structures of the modern age contain an increasing number of electronic devices and appliances that can offer an increasing level of operability. These devices can waste a lot of energy power and, as a consequence, they can strongly influence the expense balance in industrial environments as, even more, in domestic ones. A significant focus area in the global effort to protect our environment is to enable smarter electricity use.

SUMMARY OF THE INVENTION

An embodiment of the invention provides a method for a utility consumption advisor, wherein a target electricity consumption for a predefined time period is received with a user interface. User parameters are also received with the user interface, the user parameters including a list of electricity consumption items that may not be modified, a list of electricity consumption items that may be modified, and a range of modification for each of the listed electricity consumption items that may be modified. The user's electricity consumption history is determined; and, an electricity utilization plan is generated for the predefined time period with a processor. The electricity utilization plan is generated based on the target electricity consumption, the user parameters, and the user's electricity consumption history. The electricity utilization plan is implemented by wirelessly controlling the electricity consumption items that may be modified.

BRIEF DESCRIPTION OF THE SEVERAL VIEWS OF THE DRAWINGS

The present invention is described with reference to the accompanying drawings. In the drawings, like reference numbers indicate identical or functionally similar elements.

FIG. 4 is a table illustrating a utility utilization plan for a household according to an embodiment of the invention;

DETAILED DESCRIPTION

Exemplary, non-limiting, embodiments of the present invention are discussed in detail below. While specific configurations are discussed to provide a clear understanding, it should be understood that the disclosed configurations are provided for illustration purposes only. A person of ordinary skill in the art will recognize that other configurations may be used without departing from the spirit and scope of the invention.

At least one embodiment of the invention provides a method and system that generates a utility utilization plan suited to the end user that is based on a predefined target parameter. For example, a consumer may decide to spend $X on household electricity per month. The system can generate a full plan for the consumer advising on what items to use, and how the items should be used in order to reach his or her specified goal.

Figure 1:
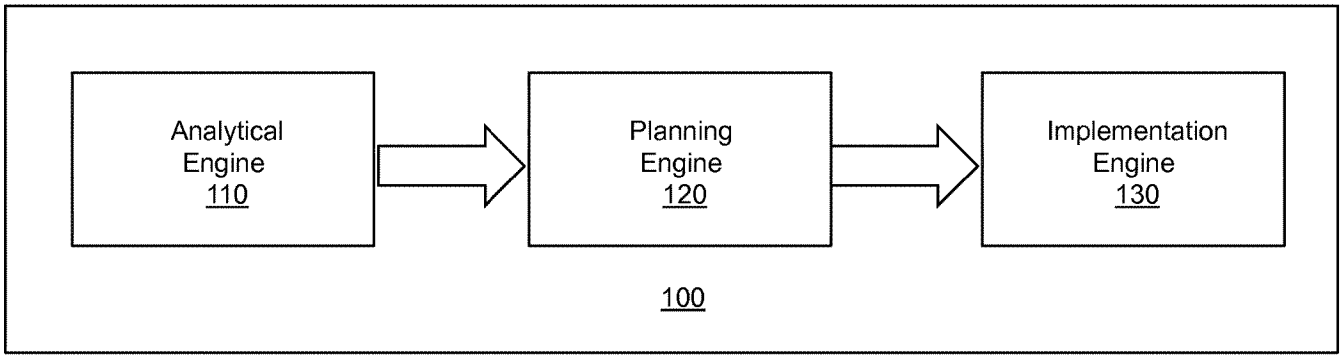
FIG. 1 illustrates a utility consumption advisor system according to an embodiment of the invention.

FIG. 1 illustrates a utility consumption advisor system 100 according to an embodiment of the invention, wherein the system 100 includes three computer hardware components: an analytical engine 110, a planning engine 120, and an implementation engine 130. The first computer hardware component, the analytical engine 110, identifies one or more energy consumption patterns of the user (also referred to herein as the "consumer"). Based on the identified pattern(s), the second computer hardware component of the system 100, the planning engine 120, generates a "reverse engineered" (working backwards from the user's goal) utility consumption plan. The utility consumption plan might be rejected if it is unreachable based on the energy consumption pattern and/or given limitations (e.g., the temperature in the living quarters should be maintained at or above 55 degrees Fahrenheit). Once the generated utility consumption plan is accepted by the user, the third computer hardware component of the system 100, the implementation engine 130, implements the utility consumption plan over the time period that is encompassed by the plan.

At least one embodiment of the invention provides a method and apparatus (also referred to herein as a "system") for optimizing utility consumption based on one or more user specific targets. The user specific targets can include a target utility consumption based on the user's defined financial budget and/or the user's defined energy level (e.g., maximum total wattage). The method analyzes household electric consumption and defines one or more optimal utilization plans that meet the user's defined target.

In at least one embodiment, the system collects utility consumption information from the appliances located within the living space (e.g., apartment, townhome, single family home). The collection can be automatic from smart sensors and meters or the information can be manually entered based on previous monthly bills. For example, the refrigerator, stove, microwave, and dishwasher can each include a sensor that is wirelessly connected to a central smart meter for delivering usage information and responding to commands. The current monetary rates for consumption of variable utilities are also entered into the system. As used herein, the term "utility" and "utilities" include gas, water, and electricity.

The user can also enter a specific monetary budget for utility consumption (e.g., electrical: $300 per month) into the interface, along with preferences as to which utilities and/or appliances can be adjusted (e.g., air conditioner, washer, and dryer), and their desired ranges. For instance, the user may have better control over water usage (e.g., a small household with no children), electrical output (less need for lighting in summer months), or climate control (temperate climate).

Based on the preferences and the utility rates, the system can determine a plan to meet the monetary goal for utilities. For example, the system can indicate that the thermostat can be set to 70 degrees during the day and then lowered to 65 degrees during the evening, and that one load of laundry can be done every 3 days. The system may also indicate that given the user preferences, the particular goal cannot be met and the expected utility charges will exceed the goal by $XYZ.

Figure 2:
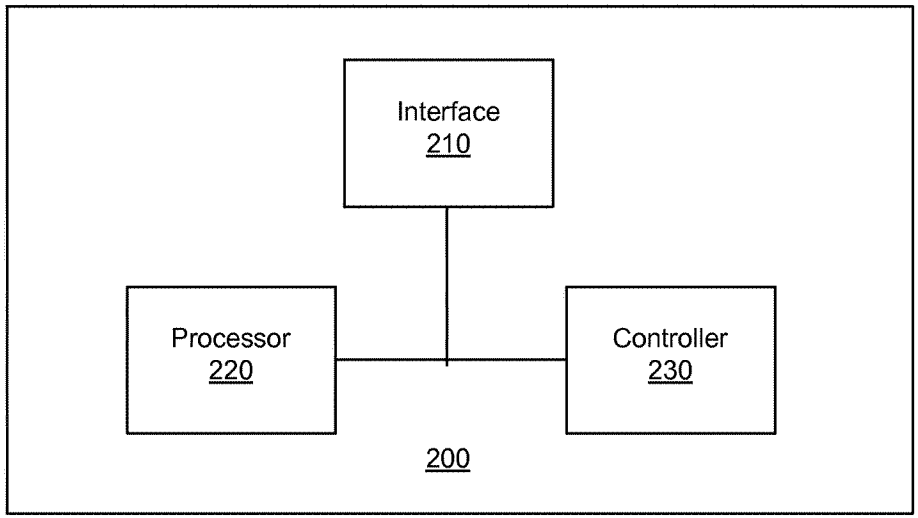
FIG. 2 illustrates a utility consumption advisor system according to another embodiment of the invention.

FIG. 2 illustrates a utility consumption advisor system 200 according to another embodiment of the invention, wherein the system 200 includes a user interface 210, a processor 220, and a controller 230. As used herein, the term "interface" includes a computer hardware component that receives input from a user. The interface 210 can include a keyboard, touchscreen display, mouse, microphone, etc. As used herein, the term "processor" includes a computer hardware component (e.g., CPU) that is connected to the interface 210. As used herein, the term "controller" includes a computer hardware component that is connected to the processor 220. In at least one embodiment, the user interface 210, processor 220, and controller 230 are all contained in a wall-mounted housing.

Figure 3:
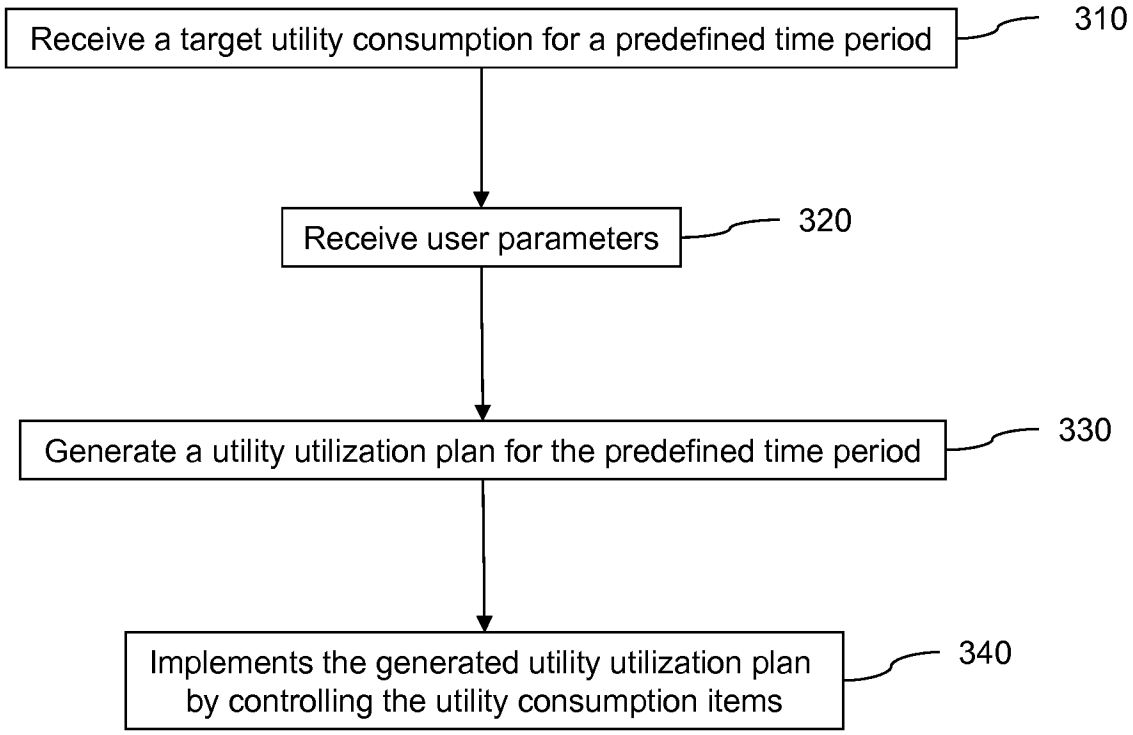
FIG. 3 is a flow diagram illustrating a method for a utility consumption advisor according to an embodiment of the invention.

FIG. 3 is a flow diagram illustrating a method for a utility consumption advisor (e.g., using the system 200) according to an embodiment of the invention. The interface 210 receives a target utility consumption (also referred to herein as a "target electricity consumption") for a predefined time period 310. The target utility consumption can include the maximum cost for the utility allowed based on the user's budget or the maximum amount of energy usage allowed based on a user preference. For example, the target utility consumption for a household is $300 a month. In another example, the target utility consumption for a business office is 1,000 kilowatt hours a week.

In at least one embodiment, the target utility consumption includes the maximum cost for the utility allowed based on the user's budget and the maximum amount of energy usage allowed based on the user preference. In this embodiment, the target utility consumption is exceeded when at least one of the maximum cost or the maximum amount of energy usage is exceeded.

The interface 210 also receives user parameters 320, wherein the user parameters can include a list of utility consumption items that may be modified and/or a list of utility consumption items that may not be modified. The utility consumption items can be household or business items, such as, for example, a washer, dryer, refrigerator, stove, oven, fax machine, copier, and/or other industrial machines/equipment. As used herein, the term "household" includes single family homes, townhomes, condominium units, apartment units, and other living quarters. The term "business" or "businesses" as used herein can include offices, retail stores, restaurants, factories, warehouses, etc.

The user parameters can also include a range of modification for each of the listed utility consumption items that may be modified. For example, a user parameter provides that an oven can use between 100-200 kilowatt hours a day. In another example, a user parameter provides that the monthly cost for operating an air-conditioning unit can be between $50-$200. In yet another example, a user parameter provides that the permitted usage and cost ranges for a fire protection system cannot be modified.

The processor 220 generates a utility utilization plan (also referred to herein as an "electricity utilization plan") for the predefined time period 330. The processor 220 can generate the utility utilization plan for a household or business based on the target utility consumption and the user parameters. FIG. 4 is a table illustrating an exemplary utility utilization plan for a household according to an embodiment of the invention, wherein permitted monthly consumptions are provided for the following utility consumption items: refrigerator, stove, microwave, dishwasher, water filter, washer, dryer, water heater, air conditioner, heater, television unit, and desktop computer. Although FIG. 4 illustrates that the permitted consumption is represented in kilowatt hours, the permitted consumption can be provided in cost in dollars in another embodiment.

In another embodiment of the invention, the utility utilization plan includes utility consumption items that have different permitted consumptions for different time periods. For instance, a utility consumption item can have a different permitted consumption depending on the time of day (e.g., night vs. day), the day of the week (e.g., weekdays vs. weekends), and/or the month of the year (e.g., seasons). For example, kitchen appliances (with the exception of the refrigerator) can have lower permitted consumptions during work and night time hours and higher permitted consumptions in the morning and evening hours. In another example, an air conditioning unit has lower permitted consumptions in December, January, and February, and higher permitted consumptions in June, July, and August.

In at least one embodiment of the invention, the processor 220 sends an alert (e.g., e-mail, text message) to the user when a utility consumption item is approaching its permitted consumption (e.g., within 100 kWh or 10%) and/or when a utility consumption item has exceeded its permitted consumption. The alert can include suggestions of how to modify the usage or permitted consumption of other utility consumption item(s). For example, if the washer has exceeded its permitted consumption, the processor 220 can suggest that the user reduce the permitted consumption of the dryer by 500 kilowatt hours.

In at least one embodiment of the invention, the processor 220 generates the utility utilization plan by modifying the permitted utility consumption of the utility consumption items that may be modified (e.g., the left column in FIG. 4) while adhering to the target utility consumption and the range of modification for each of the listed utility consumption items that may be modified.

In another embodiment of the invention, the processor 220 determines the user's utility consumption history. For example, the processor 220 determines how much electricity the television unit uses in the evening (e.g., 5:00 PM-11:59 PM), how much gas the user uses in the winter, and/or the user's electricity bill for the past 5 months. In this embodiment, the utility utilization plan is generated based on the user's utility consumption history. For instance, the generation of the utility utilization plan can include modifying the permitted utility consumption for utility consumption items that are utilized less frequently prior to the modification of the permitted utility consumption of utility consumption items that are utilized more frequently. For example, the processor 220 modifies the permitted consumption of the water heater, heater, and/or water filter during winter months prior to modifying the permitted utility consumption of other utility consumption items. In another example, the permitted consumption of the washer and dryer on Saturdays and Sundays are modified prior to modifying the permitted utility consumption of other utility consumption items.

In at least one embodiment, the controller 230 implements the generated utility utilization plan by controlling the utility consumption items that may be modified 340. More specifically, the controller 230 can transmit wired or wireless signals to the utility consumption items, wherein the signals can include commands to alter the power consumption of the utility items. For example, the controller 230 sends a signal to the thermostat, air conditioner, or heater that adjusts the output of the unit, thereby increasing or decreasing power consumption of the unit. In another example, the controller 230 sends a wireless signal to the water heater to increase electricity usage between 5:00 AM-8:00 AM and decrease electricity usage between 9:00 AM-4:00 PM.

In another embodiment of the invention, the processor 220 receives the current cost per unit for the utility (also referred to herein as the "utility rate"). The processor 220 can receive the utility rate via manual input via the user interface 210, by extracting data from the internet, and/or the processor 220 can receive the utility rate directly from the utility provider. The processor 220 can generate the utility utilization plan based on the utility rates. For example, if the target utility consumption is $200 a month, the utility rate is $0.1640869 per kilowatt hour, and there are ten utility consumption items, then the utility utilization plan divides 1,219 kilowatt hours of permitted consumption between the ten utility consumption items. In one embodiment, only four of the ten utility consumption items may be modified, wherein 800 kilowatt hours are reserved for the six utility consumption items that may not be modified. The utility utilization plan can divide the remaining 419 kilowatt hours evenly or unevenly between the four utility consumption items that may be modified.

Figure 5:
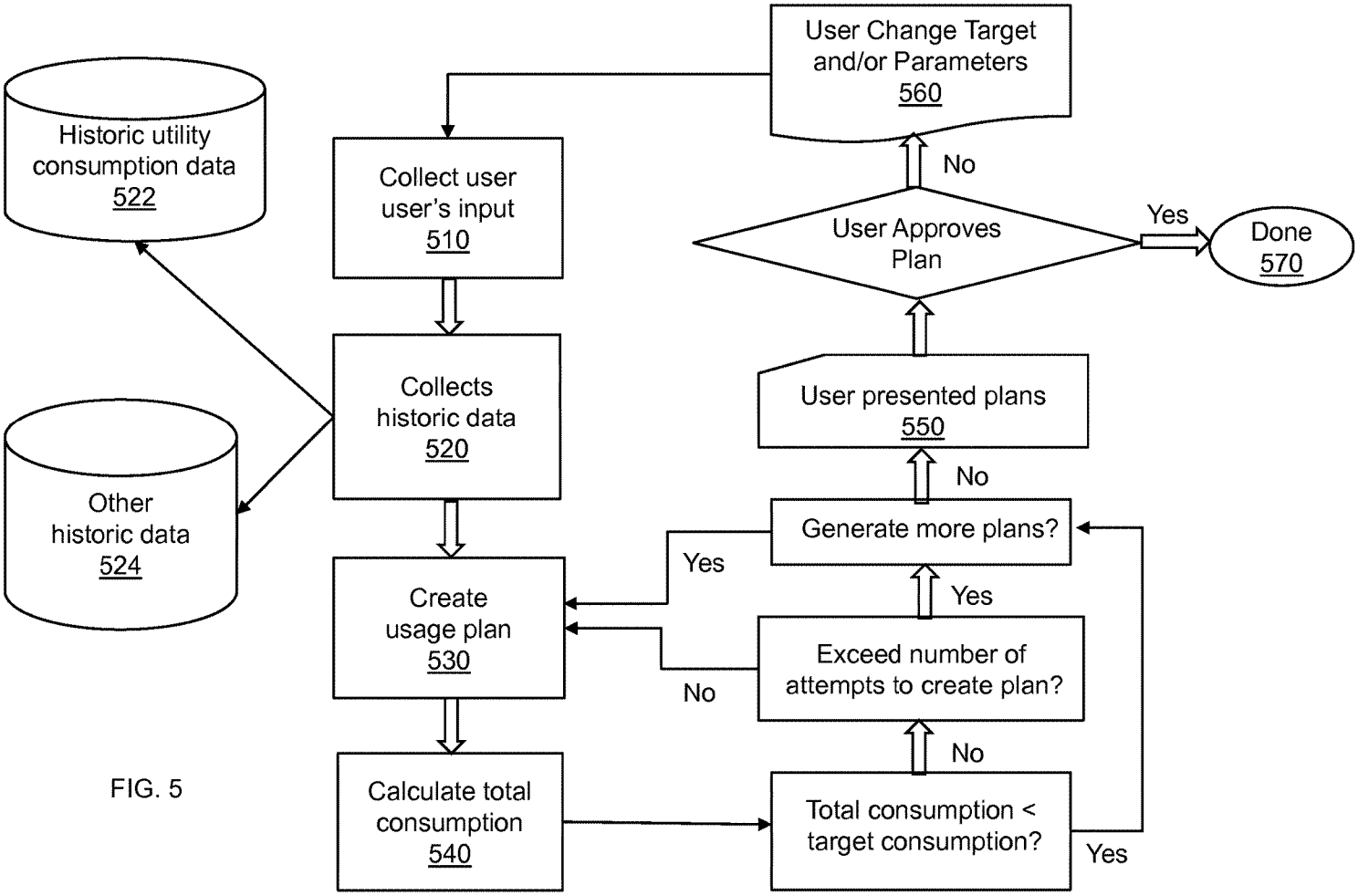
FIG. 5 is a flow diagram illustrating a method for a utility consumption advisor according to another embodiment of the invention.

FIG. 5 is a flow diagram illustrating a method for a utility consumption advisor according to another embodiment of the invention, wherein the utility consumption advisor collects a user's input 510. The user's input can include the target consumption, a list of household devices that consume energy, the number of people in the household, the number and size of rooms, and consumption preferences. The consumption preferences can include, for example, the minimum room temperature at night, the number of washer/dryer loads per week, television watching hours, etc.

The utility consumption advisor also collects historic data that is relevant to the data collected from user 520. This can include historic utility consumption data 522, such as, for example, energy used for: one washer/dryer load, one hour of television, increasing room temperature one degree for one hour, and/or one hour of refrigerator use. Other historic data can be collected 524, such as, for example, the cost per unit of energy, the average outside temperature per month, etc.

The utility consumption advisor creates a usage plan 530 and calculates the total energy consumption 550. If the total energy consumption is not less than the target consumption and the utility consumption advisor has not exceeded the maximum number of attempts to create a usage plan, then the utility consumption advisor creates another usage plan. If the total energy consumption is not less than the target consumption and the utility consumption advisor has exceeded the maximum number of attempts to create a usage plan, then the user is asked whether to generate more plans than already generated. If the total energy consumption is less than the target consumption, then the user is asked whether to generate more plans than already generated 550.

If the user chooses to generate more plans than already generated, then the utility consumption advisor creates another usage plan. If the user chooses not to generate more plans than already generated, then the user is presented with successful and/or failed usage plans 550. If the user does not approve the usage plan(s), then the user changes the target consumption and/or parameters 560. If the user approves the usage plan(s), then the utility consumption advisor exits 570.

Figure 6:
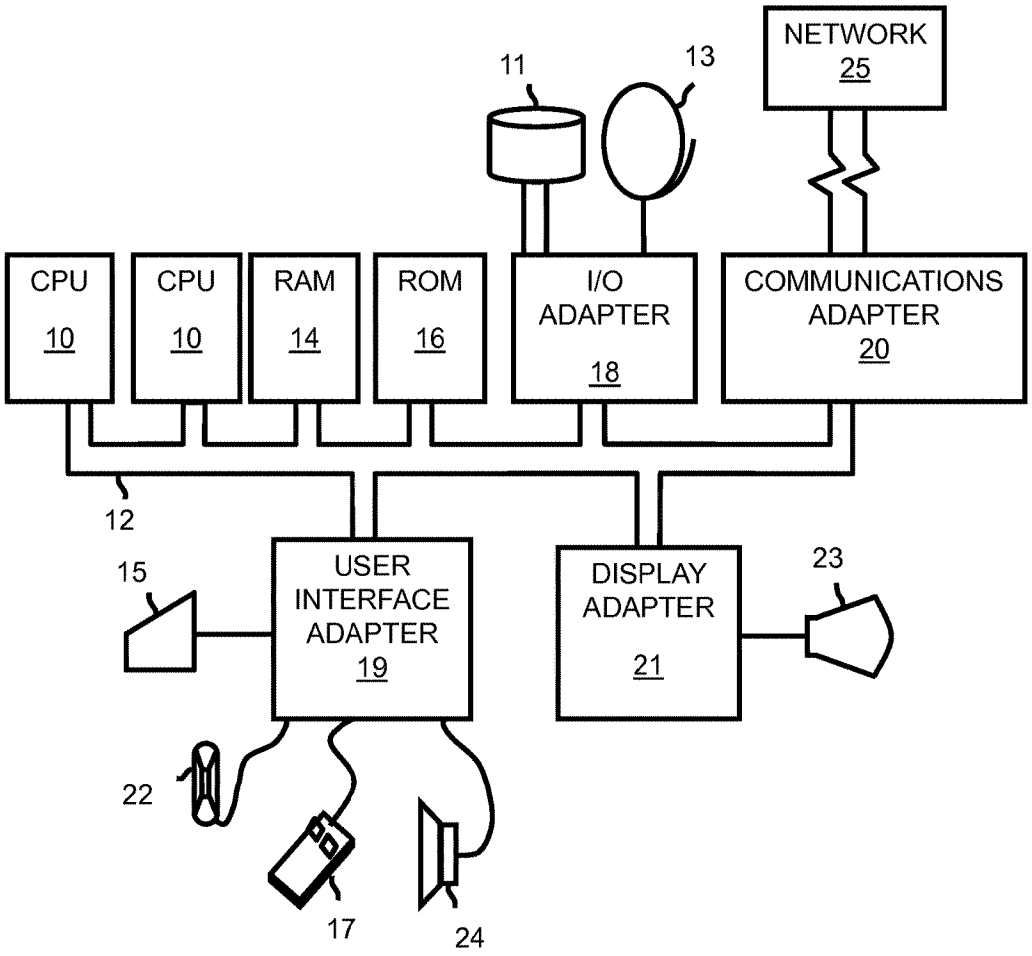
FIG. 6 illustrates a computer program product according to an embodiment of the invention.

Referring now to FIG. 6, a representative hardware environment for practicing at least one embodiment of the invention is depicted. This schematic drawing illustrates a hardware configuration of an information handling/computer system in accordance with at least one embodiment of the invention. The system comprises at least one processor or central processing unit (CPU) 10. The CPUs 10 are interconnected with system bus 12 to various devices such as a random access memory (RAM) 14, read-only memory (ROM) 16, and an input/output (I/O) adapter 18. As used herein, device the term "device" also includes a computer, processor, switch, router, processing circuit, etc. The I/O adapter 18 can connect to peripheral devices, such as disk units 11 and tape drives 13, or other program storage devices that are readable by the system. The system can read the inventive instructions on the program storage devices and follow these instructions to execute the methodology of at least one embodiment of the invention. The system further includes a user interface adapter 19 that connects a keyboard 15, mouse 17, speaker 24, microphone 22, and/or other user interface devices such as a touch screen device (not shown) to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the root terms "include" and/or "have", when used in this specification, specify the presence of stated features, integers, steps, operations, elements, and/or components, but do not preclude the presence or addition of at least one other feature, integer, step, operation, element, component, and/or groups thereof.

The corresponding structures, materials, acts, and equivalents of all means plus function elements in the claims below are intended to include any structure, or material, for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method comprising:

receiving a target utility consumption for a predefined time period through a user interface;

receiving user parameters through the user interface, the user parameters including:

a list of utility consumption items that may not be modified, a list of utility consumption items that may be modified, and a range of modification for each of the listed utility consumption items that may be modified;

generating a utility utilization plan for the predefined time period by a processor, wherein the utility utilization plan is generated based on the target utility consumption and the user parameters; and determining the user's utility consumption history, wherein said generating of the utility utilization plan is further based on the user's utility consumption history, wherein said generating of the utility utilization plan comprises modifying permitted utility consumption of utility consumption items that are utilized less frequently prior to modifying permitted utility consumption of utility consumption items that are utilized more frequently.

2. The method according to claim 1, wherein the target utility consumption includes at least one of:

a maximum cost based on the user's budget; and a maximum amount of energy usage based on a user preference.

3. The method according to claim 1, wherein said generating of the utility utilization plan comprises modifying permitted utility consumption of the utility consumption items that may be modified while adhering to the target utility consumption and the range of modification for each of the listed utility consumption items that may be modified.

4. The method according to claim 1, further comprising implementing the utility utilization plan by controlling the utility consumption items that may be modified.

5. The method according to claim 1, further comprising:

receiving a utility rate, the utility rate including a cost per unit for the utility, wherein said generating of the utility utilization plan is further based on the utility rate.

6. The method according to claim 1, further comprising modifying at least one parameter of the utility utilization plan to generate multiple plans.

7. The method according to claim 1, further comprising implementing the utility utilization plan by controlling the utility consumption items that may be modified.

8. The method according to claim 1, wherein the utility utilization plan is modified when utility rates change.

9. A computer program product comprising:

a non-transitory computer readable storage medium having stored thereon: first program instructions executable by a device to cause the device to receive a target electricity consumption for a predefined time period;

second program instructions executable by the device to cause the device to receive user parameters including:

a list of electricity consumption items that may not be modified, a list of electricity consumption items that may be modified, and a range of modification for each of the listed electricity consumption items that may be modified;

third program instructions executable by the device to cause the device to determine the user's electricity consumption history;

fourth program instructions executable by the device to cause the device to generate an electricity utilization plan for the predefined time period, wherein the electricity utilization plan is generated based on the target electricity consumption, the user parameters, and the user's electricity consumption history;

fifth program instructions executable by the device to cause the device to implement the electricity utilization plan by wirelessly controlling the electricity consumption items that may be modified;

sixth program instructions executable by the device to cause the device to determine the user's utility consumption history;

wherein the generating of the utility utilization plan in the fourth program instructions is further based on the user's utility consumption history as determined by the sixth program instructions, and wherein the generating of the utility utilization plan in the fourth program instructions comprises modifying permitted utility consumption of utility consumption items that are utilized less frequently prior to modifying permitted utility consumption of utility consumption items that are utilized more frequently.

10. The computer program product according to claim 9, wherein said generating of the electricity utilization plan comprises modifying permitted electricity consumption of the electricity consumption items that may be modified while adhering to the target electricity consumption and the range of modification for each of the listed electricity consumption items that may be modified.

11. The computer program product according to claim 9, further comprising:

receiving electricity rates, the electricity rates including a cost per unit for the electricity, wherein said generating of the electricity utilization plan is further based on the electricity rates.

* * * * *